US007132017B2

(12) United States Patent
Laurence

(10) Patent No.: US 7,132,017 B2
(45) Date of Patent: Nov. 7, 2006

(54) LOW-PRESSURE CLEANING SYSTEM USING HIGH VELOCITY HIGH VOLUME AIR

(76) Inventor: George M. Laurence, 710 Geneva Ave., Romeoville, IL (US) 60441

( * ) Notice: Subject to any disclaimer, the term of this patent is extended or adjusted under 35 U.S.C. 154(b) by 0 days.

(21) Appl. No.: 10/645,445

(22) Filed: Aug. 21, 2003

(65) Prior Publication Data

US 2004/0035446 A1 Feb. 26, 2004

Related U.S. Application Data

(60) Provisional application No. 60/404,880, filed on Aug. 21, 2002.

(51) Int. Cl.
*B08B 9/00* (2006.01)

(52) U.S. Cl. ..... 134/30; 134/2; 134/21; 134/22.1; 134/22.11; 134/22.12; 134/22.15; 134/22.18; 134/34; 134/36; 134/42; 15/304; 15/316.1; 15/405; 15/406

(58) Field of Classification Search ..... 134/26, 134/30, 2, 21, 22.1, 22.11, 22.12, 22.15, 22.18, 134/34, 36, 42; 15/304, 316.1, 405, 406
See application file for complete search history.

(56) References Cited

U.S. PATENT DOCUMENTS 3,797,744 A 3/1974 Smith
4,025,362 A * 5/1977 Frauenfeld ..... 134/57 R
4,141,754 A * 2/1979 Frauenfeld ..... 134/24
4,413,785 A 11/1983 Engelbert et al.
4,420,313 A * 12/1983 Hada et al. ..... 95/279
4,569,483 A 2/1986 Oberdorfer
4,649,987 A * 3/1987 Frauenfeld et al. ..... 165/5
4,666,531 A * 5/1987 Minard ..... 134/26
RE32,517 E * 10/1987 Nelson ..... 122/379
4,850,809 A 7/1989 Smith
5,040,262 A * 8/1991 Albers et al. ..... 15/316.1
5,058,807 A 10/1991 Smith
5,076,856 A * 12/1991 Schweiger ..... 134/18
5,165,604 A 11/1992 Copp, Jr.
5,331,985 A * 7/1994 Lyons ..... 134/66
5,667,139 A * 9/1997 Dickie ..... 239/263.3
6,029,909 A 2/2000 Smith
6,062,486 A 5/2000 Hill
6,065,528 A * 5/2000 Fierle et al. ..... 165/5
6,105,204 A 8/2000 Scharwat
6,578,777 B1 * 6/2003 Bui ..... 239/406
6,598,805 B1 7/2003 Sakai et al.
2004/0006841 A1 * 1/2004 Jameel et al. ..... 15/318.1
2004/0035446 A1 * 2/2004 Laurence ..... 134/30

* cited by examiner

*Primary Examiner*—Sharidan Carrillo
(74) *Attorney, Agent, or Firm*—Ice Miller LLP

(57) ABSTRACT

A method for cleaning a heat exchanging coil in an air conditioning unit using a low-pressure cleaning system to remove foreign particles that have accumulated on the heat exchanging coil. The low-pressure cleaning system discharges air at a low pressure, high velocity, and a high volume in order to clean the heat exchanging coil. Further, the low-pressure cleaning system can inject a substance into the discharge air flow to aid in cleaning the heat exchanging coil.

16 Claims, 4 Drawing Sheets

LOW-PRESSURE CLEANING SYSTEM USING HIGH VELOCITY HIGH VOLUME AIR

CROSS-REFERENCE TO RELATED APPLICATIONS

This application claims the benefit of U.S. Provisional Application No. 60/404,880, filed Aug. 21, 2002.

BACKGROUND OF THE INVENTION

Air conditioning systems, such as roof top units that cool the air inside a building, rely on the efficient transfer of heat from a refrigeration fluid to the air through heat exchangers. Heat exchangers generally comprise a "heat exchanging coil" comprising one or more tubes interconnected by a plurality of thin metal fins that serve to increase the surface area of the tubes that is exposed to the air. As compressed refrigeration fluid passes through the tubes, a fan draws unfiltered air through the fins and around the tubes to facilitate cooling of the refrigeration fluid inside the tubes. The unfiltered air tends to carry dirt and debris from the surrounding environment, some of which becomes trapped in the spaces between the tubes and the fins. The efficiency of a heat exchanging coil in transferring heat from a refrigeration fluid to the air depends on how freely the air moves through the spaces between the tubes and the fins. If the spaces between the tubes and the fins are clogged by dirt and debris, the efficiency of a heat exchanging coil drops significantly.

Regular maintenance of the heat exchanging coil is important to maintain efficient heat transfer. Traditionally, heat exchanging coils are cleaned in a variety of ways, including, but not limited to, the use of high pressure "pressure washers." Pressure washers force high-pressure (1000 pounds per square inch ("psi") or higher) air or water through a small, usually hand-held nozzle that directs high-pressure air or water toward the heat exchanging coil to blow dirt and debris from the spaces between the tubes and the fins. The effective cleaning area of the air or water stream is approximately the size of the small nozzle orifice, which may be one-eighth inch to three-eighths of an inch (⅛–⅜") in diameter in some cases. Significant labor costs are incurred when using small orifice, high-pressure nozzles because of the number of passes that must be made by the operator to clean a desired region of the heat exchanging coil.

The use of water-based pressure washers has several disadvantages. Water-based pressure cleaners typically require even higher pressures than do air-based pressure cleaners, because water has a much higher drag coefficient than air and is more difficult to "push" through a typical heat exchanging coil. Moreover, the large volume of water gallons per minute typically needed to clean a heat exchanging coil can cause damage to other components of an air conditioning system, which could lead to an electrical short in the circuitry of the air conditioning system. Further, the use of a large volume of water can cause damage to an adjacent building or other surrounding materials near the air conditioning system that is being cleaned. In order to prevent this damage, significant labor time is required to mask-off air conditioner components and the surrounding building to prevent or limit water damage during water-based cleaning of a heat exchanging coil.

Any type of high-pressure cleaning method can cause damage to a heat exchanging coil because the high pressure tends to bend the fins and/or fold the fins over, which closes the space between the tubes and the fins and leads to a loss of heat exchanger efficiency. In addition, high pressure water cleaning methods always impose extreme force on the coil bundle which can loosen the tight fit between the fin and tube causing reduced efficiency and mechanical damage. Thus, there is a need for an improved system for cleaning heat exchanging coils that reduces the labor time required to clean a coil, reduces the risk of damage to the coil fins, reduces the labor time needed to mask and clean a coil, and reduces the possibility of damage to the building on which the heat exchanging coil is installed.

BRIEF SUMMARY OF THE INVENTION

The subject invention relates to the cleaning of an exposed heat exchanging coil with high velocity, high volume, low pressure air and when needed a cleaning fluid mist. Specifically, it relates to a method for cleaning a heat exchanging coil using a low-pressure cleaning system to remove foreign particles that have accumulated on the heat exchanging coil. An operator of the low-pressure cleaning system can discharge air at a low pressure from the low-pressure cleaning system so that the air passes through the heat exchanging coil. The discharge air flow from the cleaning system will dislodge foreign particles that have accumulated on the heat exchanging coil. Further, the low-pressure cleaning system can inject a substance, such as a cleaning fluid mist, into the discharge air flow so that the substance will pass through the heat exchanging coil and aid in the cleaning of the coil if needed.

In one of the embodiments, the low-pressure cleaning system comprises a pressure source that creates movement of air and a discharge tube with a first end connected to the pressure source so that air will pass from the pressure source into the discharge tube and a second end with or without an attachment that allows air to exit out of the discharge tube at a pressure of less than about 50 pounds per square inch, at a velocity greater than about 180 miles per hour ("mph") and at a volume greater than about 440 cubic feet per minute ("cfm"). The second end and/or the attachment on the second end usually ranges in diameter from one inch to two-and-a-half inches in size (1–2½"). In another embodiment, an injector is placed within the discharge tube. The injector has a spray nozzle connected to a valve by a hose so that a substance can enter through the valve and be emitted into the discharging air flow from the spray nozzle. The subject invention has applications in many industries, particularly the air conditioning industry, for cleaning heat exchanger coils in air conditioning condensers.

DETAILED DESCRIPTION OF THE INVENTION

Figure 1:
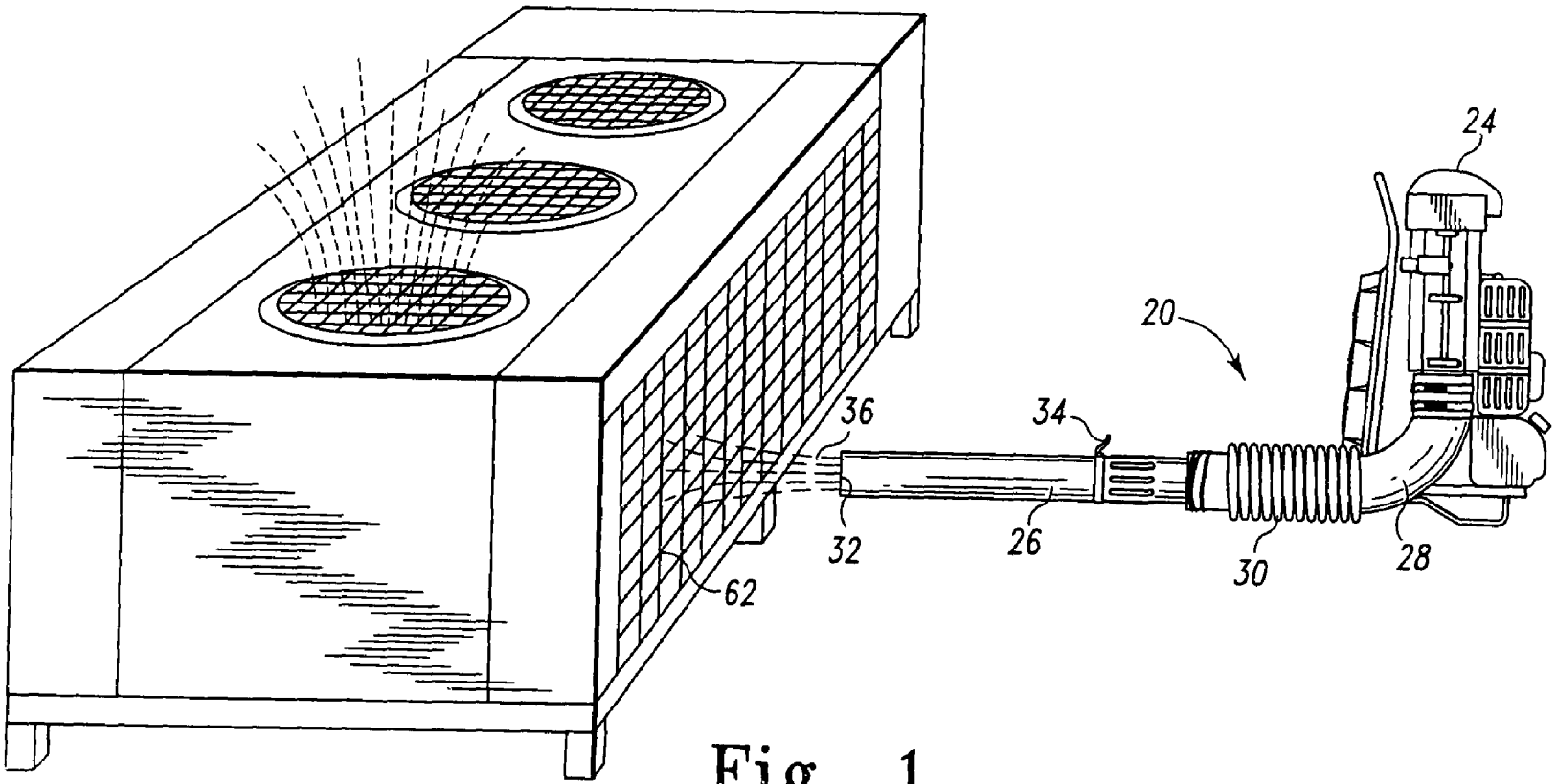
FIG. 1 shows a side view of an exemplary embodiment of the low-pressure cleaning system being used to clean a heat exchanging coil in an air condition unit.

FIG. 1 shows a side view of an embodiment of the subject invention being used to clean an exposed heat exchanging coil 62 in an air conditioning unit 22. As shown in FIG. 1, the embodiment comprises a low-pressure cleaning system 20. Low-pressure cleaning system 20 comprises a pressure source 24, such as a centrifugal fan, for creating the movement of air. Pressure source 24 is coupled to an air admitting end 28 of a discharge tube 26. Discharge tube has a flexible portion 30 and has a discharge orifice 32. In this embodiment, discharge tube 26 has a flexible portion 30. Further, a handle 35 is attached to discharge tube 26 to aid in the operation of low-pressure cleaning system 20. Although handle 35 and flexible portion 30 are not required, they do allow the discharge tube 26 to be aimed in different directions. In this embodiment, discharge tube 26 and discharge orifice 32 have approximately the same diameter of at least approximately two and three-eighths inches (2⅜"). However, the diameter of the discharge tube can be adjusted to any diameter to adjust the volume and velocity of the discharge air flow, as needed. Ideally, the diameter of the discharge tube and/or discharge orifice will be between one inch and two-and-a-half inches (1–2½") in size. It will also be appreciated by one skilled in the art that the capacity of the pressure source can be adjusted to adjust the volume and velocity of the discharge air flow. Moreover, it will be appreciated by one skilled in the art that the low-pressure cleaning system is not limited to air conditioning units but, rather, can be utilized to clean anything with a heat exchanging coil that allows air to pass through it.

During operation, pressure source 24 causes air to travel through discharge tube 26 so that a discharge air flow 36 emits from discharge orifice 32 at a low pressure. "Low pressure" comprises a pressure of less than about 50 psi. While the low-pressure cleaning system emits an air stream at a low pressure, the total energy of the air velocity and volume is sufficient to dislodge dirt and debris from the heat exchanging coil. Thus, the low-pressure cleaning system will emit air at not only a low pressure but also a high velocity and a high volume. While the velocity and volume can be any level sufficient to dislodge dirt and debris from the heat exchanging coil, it is recommended that the velocity be greater than about 180 mph and the volume be greater than about 440 cfm. For example, low-pressure cleaning system 20 of FIG. 1 could comprise a gas-powered leaf blower of a type known in the art. Such as a gas powered leaf blower produces a pressure of less than 5 psi while moving about 640 cfm of air at a velocity of approximately 210 mph. Discharge air flow 36 will enter air conditioning unit 22 at a sufficient pressure, velocity and volume to dislodge dirt and debris from the heat exchanging coil 62. FIG. 1 shows the dirt and debris being blown out of the top of the air conditioning unit through the exhaust fan of the unit with exiting air 38. The low pressure of discharge air flow 36 reduces the possibility of damaging the heat exchanging coil. Further, the large diameter of discharge orifice 32 provides a larger area of discharge air flow 36 and makes cleaning the heat exchanging coil faster. Flexible portion 30 of discharge tube 26 and handle 34 allows the operator to direct the air flow 36 in different directions.

Figure 2:
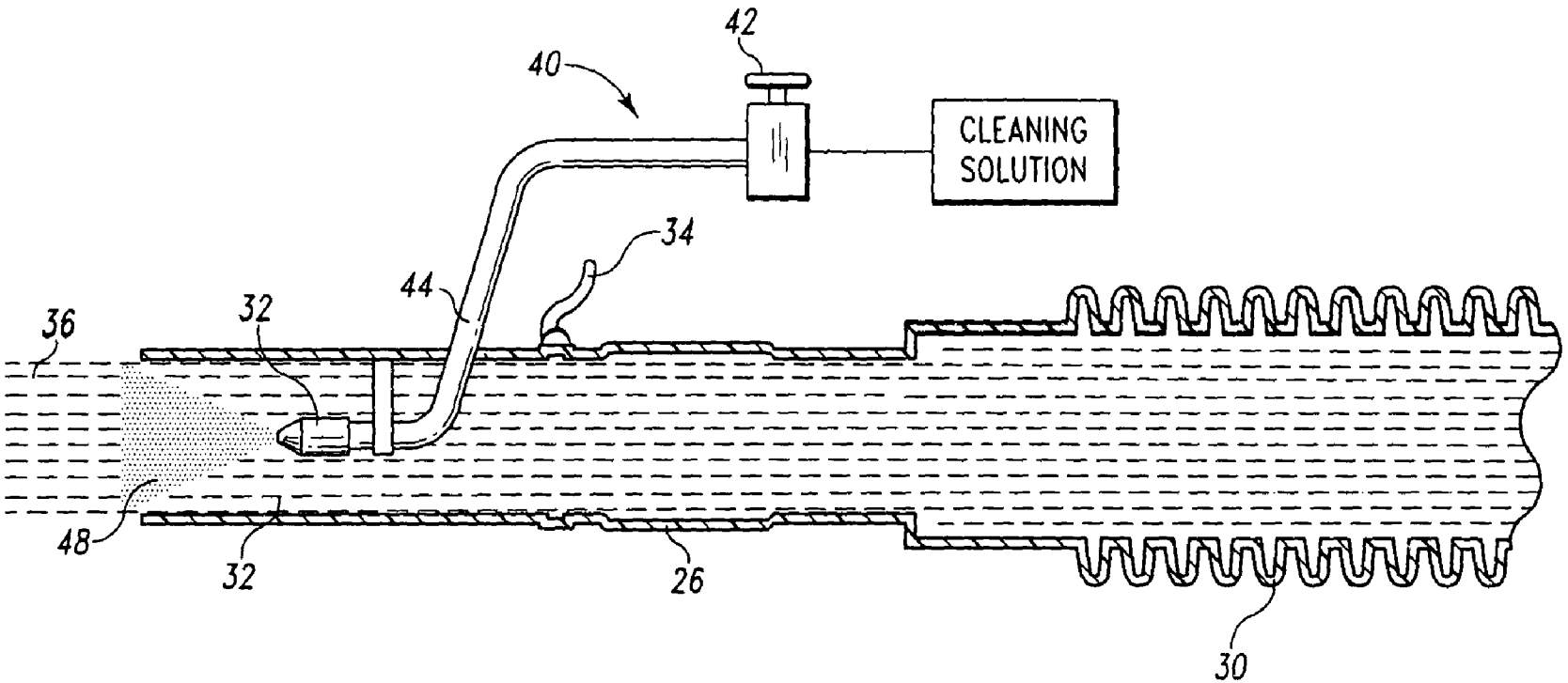
FIG. 2 shows a cross-sectional side view of the discharge tube of another embodiment of the low-pressure cleaning system.

FIG. 2 shows a side cross-sectional view of the discharge tube of another embodiment of the low-pressure cleaning system. As shown in FIG. 2, low-pressure cleaning system 20 further comprises an injector 40 that can inject a cleaning fluid into discharge air flow 36 to improve or alter the cleaning characteristics of the air. For example, a small amount of water or a water/detergent mixture can be provided as a mist 48 (or a low volume stream) to improve cleaning of some surfaces and to help remove oily residue in some cases. As shown in FIG. 2, the cleaning fluid is induced through injector 40 located inside and attached to discharge tube 26. Injector 40 has a spray nozzle 46 connected to one end of a hose 44 that connects the spray nozzle to a valve 42. Valve 42 can be connected to a reservoir that contains the cleaning fluid. In operation, the operator of this embodiment of the low-pressure cleaning system can open valve 42 and cause the cleaning fluid to be fed through hose 44 and into and out of spray nozzle 46 so that mist 48 of the cleaning solution can be injected into the discharge air flow 36. Other nozzles can be placed in the discharge tube or can engage the discharge tube so that not only cleaning agents can be injected into the discharge air flow, but also so that other useful substances, such as rinsing agents, fogging agents, and dry powders can be injected into the discharge air flow.

Figure 3:
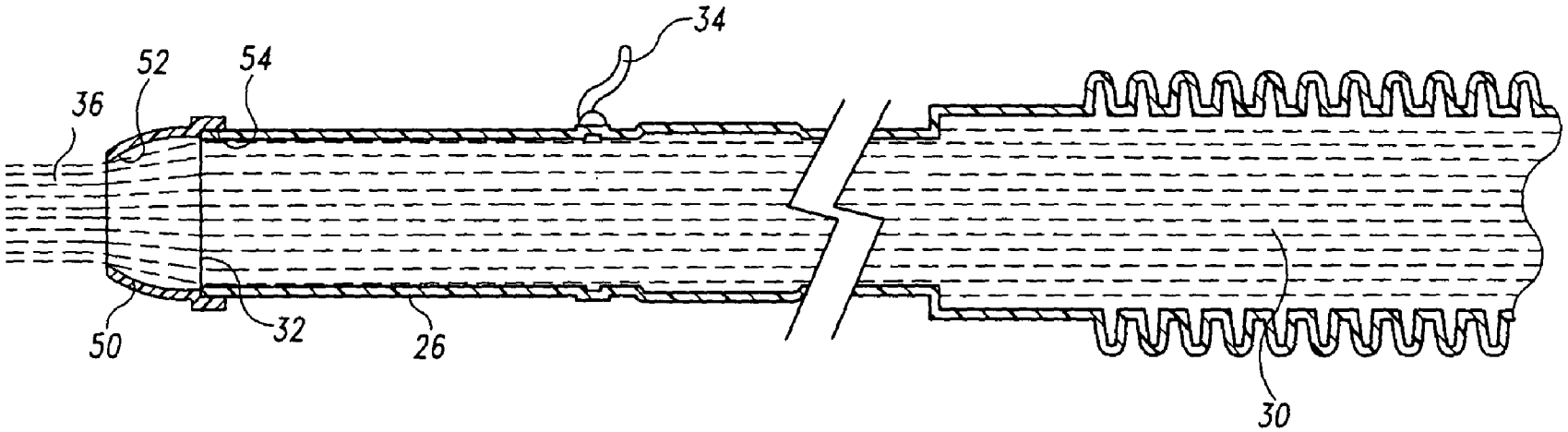
FIG. 3 shows a cross-sectional side view of the discharge tube of FIG. 1 with an attachment with a horizontal opening.
Figure 4:
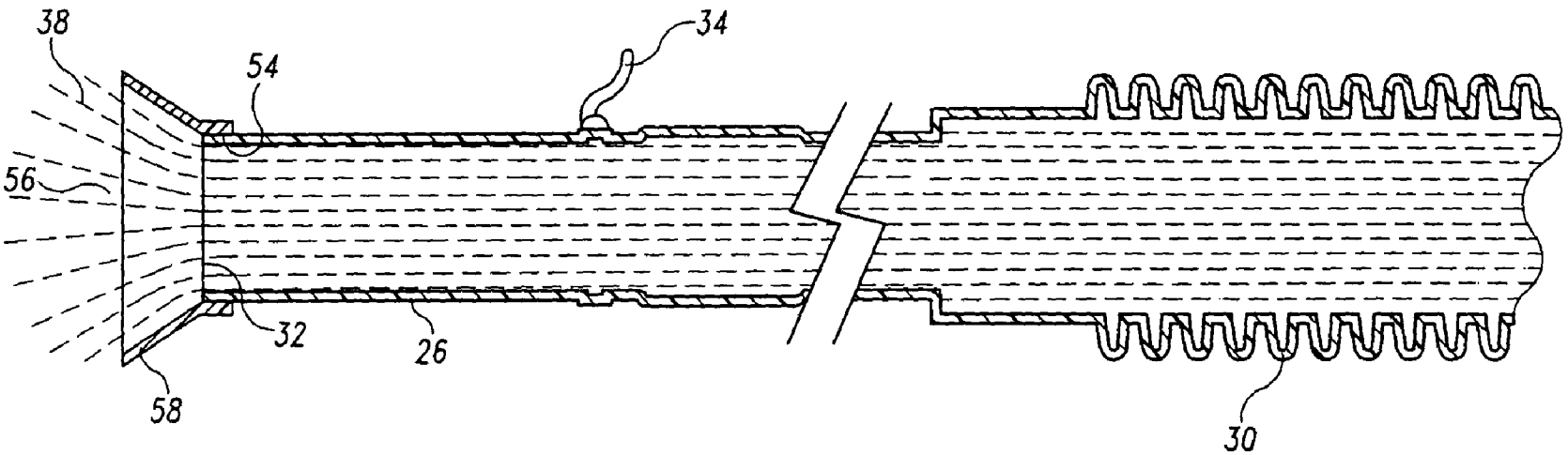
FIG. 4 shows a cross-sectional side view of the discharge tube of FIG. 1 with an attachment with a vertical opening.

A variety of attachments can be attached to discharge orifice 32 to improve/modify operation of low-pressure cleaning system 20. For example, as shown in FIG. 3, an attachment 50, having a horizontal opening 52 and an open end 54 that fits over discharge orifice 32, can be attached to the discharge orifice to focus and direct discharge air flow 36 horizontally relative to the axis of the discharge tube. Alternatively, as shown in FIG. 4, an attachment 58, having a vertical opening 56 and an open end 54 that fits over discharge orifice 32, can be attached to the discharge orifice to focus and direct discharge air flow 36 vertically relative to the axis of the discharge tube. Other attachments may engage discharge orifice 32 to aid in directing the discharge air at variable angles from the horizontal axis of the discharge tube or to improve the cleaning of the heat exchanging coil. For example, an attachment that causes the air to exit discharge tube 26 at a forty-five degree angle or a ninety degree angle relative to the axis of the discharge tube can be used to fit into tight spaces in order to effectively clean all of the heat exchanging coil. Moreover, an attachment with an opening and a brush around the opening may be engaged with the discharge orifice to help remove surface residue. While FIGS. 3 and 4 show attachments 50 and 58 being used with discharge tube 26 without injector 40, such attachments can be used with a discharge tube that has injector 40 attached thereto. Furthermore, any fan or blower capable of producing low pressure at a high volume and a high velocity can be used as a pressure source. Alternatively, an air compressor of a type known in the art that produces high velocity compressed air can be used along with a pressure-reducing attachment so that the air emanating from the discharge tube is of the desired pressure.

While the subject invention has been described in considerable detail with references to particular embodiments thereof, such is offered by way of non-limiting examples of the invention as many other versions are possible. It is anticipated that a variety of other modifications and changes will be apparent to those having ordinary skill in the art and that such modifications and changes are intended to be encompassed within the spirit and scope of the pending claims.

I claim:

1. A method for cleaning an exposed heat exchanging coil, the method comprising the steps of:

a. providing a low-pressure cleaning system having (i) a pressure source that creates movement of air, and (ii) a discharge tube with a first end connected to the pressure source so that air will pass from the pressure source into the discharge rube and a second end that allows air to exit out of the discharge tube;

b. aiming the second end of the discharge tube at the heat exchanging coil;

c. operating the low-pressure cleaning system to cause air to exit the second end of the discharge tube at a pressure less than about 50 pounds per square inch but greater than zero pounds per square inch at a velocity greater than about 180 miles per hour, and a volume of greater than 440 cubic feet per minute; and d. removing foreign particles from the heat exchanging coil by causing the exiting air to pass through the hear exchanging coil.

2. The method for cleaning the heat exchanging coil of claim 1, wherein the discharge tube has a diameter of at least approximately two inches.

3. The method for cleaning the heat exchanging coil of claim 1, wherein the air is caused to exit out of the discharge tube at less than about 5 pounds per square inch but greater than zero pounds per square inch.

4. The method for cleaning the heat exchanging coil of claim 1, further comprising the step of injecting a substance into the discharge tube.

5. The method of cleaning the heat exchanging coil of claim 1, wherein the air exits the discharge tube at a velocity of greater than about 210 miles per hour.

6. The method of cleaning the heat exchanging coil of claim 1, wherein the air exits the discharge tube at a volume of greater than about 640 cubic feet per minute.

7. The method for cleaning the heat exchanging coil of claim 4, wherein the substance comprises a cleaning solution, so that a mist of cleaning solution passes through the heat exchanging coil along with the exiting air.

8. The method for cleaning the heat exchanging coil of claim 4, wherein the substance comprises a rinsing agent.

9. The method for cleaning the heat exchanging coil of claim 4, wherein the substance comprises a fogging agent.

10. A method for cleaning an exposed heat exchanging coil, the method comprising the steps of:

a. providing a low-pressure cleaning system having (i) a pressure source that creates movement of air, (ii) a discharge tube with a first end connected to the pressure source so that air will pass from the pressure source into the discharge tube and a second end that allows air to exit out of the discharge tube, and (iii) an injector located inside the discharge tube;

b. aiming the second end of the discharge tube at the heat exchanging coil;

c. operating the low-pressure cleaning system to cause air to exit the discharge tube at a pressure less than about 50 pounds per square inch but greater than zero pounds per square inch at a velocity greater than about 180 miles per hour, and a volume of greater than 440 cubic feet per minute;

d. injecting a substance from the injector into the air exiting the discharge tube; and e. removing foreign particles from the heat exchanging coil by causing the exiting air and substance to pass through the heat exchanging coil.

11. The method for cleaning the heat exchanging coil of claim 10, wherein the discharge tube has a diameter of at least approximately two inches.

12. The method for cleaning the heat exchanging coil of claim 10, wherein the air is caused to exit out of the discharge tube at less than about 5 pounds per square inch, but greater than 0 pounds per square inch.

13. The method for cleaning the heat exchanging coil of claim 10, wherein the substance comprises a cleaning solution, so that a mist of cleaning solution passes through the heat exchanging coil along with the exiting air.

14. The method for cleaning the heat exchanging coil of claim 10, wherein the substance comprises a rinsing agent.

15. The method of cleaning the heat exchanging coil of claim 10, wherein the air exits the discharge tube at a velocity of greater than about 210 miles per hour.

16. The method for cleaning a heat exchanging coil of claim 10, wherein the air exits the discharge tube at a volume of greater than about 640 cubic feet per minute.

* * * * *